US009502202B2

(12) United States Patent
Arman et al.

(10) Patent No.: US 9,502,202 B2
(45) Date of Patent: Nov. 22, 2016

(54) SYSTEMS AND METHODS FOR GENERATING COHERENT MATTERWAVE BEAMS

(75) Inventors: Moe J. Arman, Palmdale, CA (US); Charles Chase, Lancaster, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 71 days.

(21) Appl. No.: 13/338,925

(22) Filed: Dec. 28, 2011

(65) Prior Publication Data

US 2013/0169157 A1 Jul. 4, 2013

(51) Int. Cl.
*H01J 3/02* (2006.01)
*G21K 1/08* (2006.01)

(52) U.S. Cl.
CPC .. *H01J 3/02* (2013.01); *G21K 1/08* (2013.01)

(58) Field of Classification Search
USPC ..... 315/111.81; 250/395, 336.1
See application file for complete search history.

(56) References Cited

U.S. PATENT DOCUMENTS 4,874,942 A * 10/1989 Clauser ..... G01C 19/58 250/251
4,886,964 A * 12/1989 Pritchard ..... G21K 1/06 250/251
4,957,337 A * 9/1990 Ogawa ..... B82Y 10/00 250/227.14
4,992,656 A * 2/1991 Clauser ..... G01C 19/58 250/251
5,091,980 A 2/1992 Ogawa et al.
5,153,688 A * 10/1992 Oda ..... H01L 29/66977 257/192
5,247,223 A * 9/1993 Mori ..... H01J 21/105 257/10
5,686,802 A * 11/1997 Ikegami ..... G21K 1/003 250/251
5,789,876 A * 8/1998 Umstadter ..... H05H 15/00 315/111.81

(Continued)

FOREIGN PATENT DOCUMENTS

EP 0 471 288 B1 2/2002
WO WO 2006/064093 A1 6/2006

OTHER PUBLICATIONS

Herman et al "The Aharonov-Bohm Effects . . . " Physics Today Sep. 2009 p. 38-43.*
Coq et al "Coherent matter wave . . . " Advances in Space Research 49 (2012) p. 365-372.*
Xuerb et al "Optomechanical interface . . . "Scince Reports Quantum Physics 3, p. 3378, Dec. 11, 2013.*

(Continued)

*Primary Examiner* — Douglas W Owens
*Assistant Examiner* — Srinivas Sathiraju
(74) *Attorney, Agent, or Firm* — Baker Botts L.L.P.

(57) ABSTRACT

Systems and methods for generating a coherent matterwave beam are provided. In some aspects, a system includes a plurality of beam generating units. Each of the plurality of beam generating units is configured to generate a stream of charged particles. The system also includes a magnetic field generator configured to expose the plurality of streams to a magnetic field such that (i) the charged particles of the plurality of streams undergo phase synchronization with one another in response to a vector potential associated with the magnetic field and (ii) the plurality of streams is directed along one or more channels to combine with one another and produce a coherent matterwave beam.

13 Claims, 5 Drawing Sheets

(56) References Cited

U.S. PATENT DOCUMENTS

| | | | | |
|---|---|---|---|---|
| 6,239,559 | B1 * | 5/2001 | Okamoto | H05B 41/24 315/111.21 |
| 6,476,383 | B1 * | 11/2002 | Esslinger | G21K 1/00 250/251 |
| 6,788,008 | B2 * | 9/2004 | Hiraoka | H05B 41/2806 315/207 |
| 6,822,249 | B2 * | 11/2004 | Lee | H01J 43/246 250/492.2 |
| 6,831,421 | B1 * | 12/2004 | Bletzinger | B01D 53/32 315/207 |
| 6,936,971 | B2 * | 8/2005 | Chukanov | G21B 1/00 315/108 |
| 7,038,188 | B2 * | 5/2006 | Beausoleil, Jr. | G06N 99/002 250/214.1 |
| 7,042,216 | B2 | 5/2006 | Barbic | |
| 7,180,580 | B2 * | 2/2007 | Guruprasad | G01S 11/02 356/5.09 |
| 7,566,897 | B2 * | 7/2009 | Bibilashvili | B82Y 10/00 257/24 |
| 7,589,348 | B2 * | 9/2009 | Walitzki | H01J 45/00 257/104 |
| 7,767,976 | B2 | 8/2010 | Allen et al. | |
| 7,786,472 | B2 | 8/2010 | Stafford et al. | |
| 7,851,757 | B2 | 12/2010 | Nagayama | |
| 7,894,122 | B2 * | 2/2011 | Reynolds | G02B 26/002 359/290 |
| 8,331,057 | B2 * | 12/2012 | Miyanishi | B82Y 10/00 250/338.4 |
| 8,389,948 | B2 * | 3/2013 | Arman | G01R 15/26 250/395 |
| 2007/0040503 | A1 * | 2/2007 | Chase | H01J 65/046 313/567 |
| 2007/0194225 | A1 | 8/2007 | Zorn | |
| 2008/0067561 | A1 | 3/2008 | Bibilashvili et al. | |
| 2009/0200464 | A1 | 8/2009 | Tiemeijer et al. | |
| 2009/0296258 | A1 | 12/2009 | Miyanishi et al. | |
| 2010/0012827 | A1 | 1/2010 | Vestergaard Hau | |
| 2012/0037814 | A1 * | 2/2012 | Lal | G21B 1/15 250/396 ML |
| 2013/0169157 | A1 * | 7/2013 | Arman et al. | 315/111.81 |

OTHER PUBLICATIONS

Fischer et al "Excitation storage in a Nanoscale Abaronov-Bohm Ring with electric field Tuning" PRL 102 096405 (2009).*

Tonumura et al Disturbancewithout the force Mar. 20, 2008 Nature vol. 452.*

Herman et al The Aharonov-BOhm effects Sep. 1, 2009, Physics Today vol. 62 p. 38-43, 2009.*

Sato, et al., "On the feasibility of detecting an Aharonov-Bohm phase shift in neutral matter", Journal of Physics: Conference Series 150, 25th International Conference on Low Temperature Physics, 2009, pp. 1-4.

Tonomura, "The AB effect and its expanding applications", Journal of Physics A: Mathematical and Theoretical, Aug. 2010, pp. 1-13, vol. 43, IOP Publishing Ltd.

Arndt, et al., "Interferometry with Large Molecules: Exploration of Coherence, Decoherence and Novel Beam Methods", Brazilian Journal of Physics, Jun. 2005, pp. 216-223, vol. 35, No. 2A.

Bongs, et al., "Physics with coherent matter waves", Reports on Progress in Physics, 2004, pp. 907-963, vol. 67.

Japha, et al., "Using Time-Reversal Symmetry for Sensitive Incoherent Matter-Wave Sagnac Interferometry", Physical Review Letters, 2007, pp. 060402-1-060402-4, vol. 99.

Ketterle, "Nobel lecture: When atoms behave as waves: Bose-Einstein condensation and the atom laser", Reviews of Modern Physics, Oct. 2002, pp. 1131-1151, vol. 74.

Lin, et al., "Cloaking of matter waves under the global Aharonov-Bohm effect", Physical Review A, May 27, 2009, pp. 051605-1-051605-4, vol. 79.

Caprez, et al., "Macroscopic Test of the Aharonov-Bohm Effect", Physical Review Letters, Nov. 2007, pp. 210401-1-210401-4, vol. 99.

Chirolli, et al., "Electronic implementations of interaction-free measurements", Physical Review B, Jul. 2010, pp. 045403-1-045403-11, vol. 82.

Edgcombe, "A phase plate for transmission electron microscopy using the Aharanov-Bohm effect", Journal of Physics: Conference Series 241, 2010, pp. 1-4.

Hod, "Molecular Nano-electronic Devices Based on Aharonov-Bohm Interferometry", Thesis submitted to the Senate of Tel-Aviv University, Oct. 2005.

* cited by examiner

SYSTEMS AND METHODS FOR GENERATING COHERENT MATTERWAVE BEAMS

STATEMENT AS TO RIGHTS TO INVENTIONS MADE UNDER FEDERALLY SPONSORED RESEARCH OR DEVELOPMENT

Not Applicable.

FIELD

The subject technology generally relates to coherent matterwave beams and, in particular, relates to systems and methods for generating coherent matterwave beams.

BACKGROUND

Coherent massless particle beams such as lasers have been successful and spawned many disruptive technologies. A massive counterpart to lasers, namely coherent matterwave beams, may hold the promise of similar and even more revolutionary technologies. Generating massive coherent beams, however, has been elusive. A major obstacle in producing coherence in matterwaves is to change the phase of beam particles without modifying the energy of the particles. Conventional phase modifying effects may lead to a change in the energy, thus modifying the wavelength of the particles and making it difficult to synchronize the particles for coherence. While coherence for photons may be achieved through photon emission enhancement via resonance, a similar technique for massive particles (e.g., particles with mass) may not work because the velocity of the massive particles is a function of the wavelength. The speed of photons is the speed of light, regardless of the energy. This dependence of the energy on the speed of the particles may make it difficult for massive particles to become coherent unless a way is found for changing the massive particle phase without changing the energy.

SUMMARY

According to various aspects of the subject technology, a directed beam of low-entropy coherent massive particles similar to laser beams may be produced, but with concentrations millions of times higher than any intense laser beams currently available. Furthermore, unlike laser beams or the Bose-Einstein condensate (BEC) (e.g., a form of coherent matterwave), the subject technology may produce coherent matterwaves that allow both Fermions and Bosons to achieve coherence.

According to various aspects of the subject technology, a system for generating a coherent matterwave beam is provided. The system comprises a plurality of beam generating units disposed. Each of the plurality of beam generating units is configured to generate a stream of charged particles. The system also comprises a magnetic field generator configured to expose the plurality of streams to a magnetic field such that (i) the charged particles of the plurality of streams undergo phase synchronization with one another in response to a vector potential associated with the magnetic field and (ii) the plurality of streams is directed along one or more channels to combine with one another and produce a coherent matterwave beam.

According to various aspects of the subject technology, a method for generating a coherent matterwave beam is provided. The method comprises generating a plurality of streams of charged particles. The method also comprises exposing the plurality of streams to a magnetic field such that (i) the charged particles of the plurality of streams undergo phase synchronization with one another in response to a vector potential associated with the magnetic field and (ii) the plurality of streams is directed along the same direction to combine with one another and produce a coherent matterwave beam.

According to various aspects of the subject technology, a system for generating a coherent matterwave beam is provided. The system comprises a housing having one or more channels. The system also comprises at least one beam generating unit disposed within the housing. The at least one beam generating unit is configured to generate a stream of charged particles. The charged particles are generated with the same non-zero kinetic energy as one another. The charged particles comprise Fermions. The system also comprises a magnetic field generator configured to expose the stream to a magnetic field such that (i) the charged particles of the stream, in response to a vector potential associated with the magnetic field, undergo phase synchronization with one another without exchanging energy with one another and (ii) the stream is directed along the one or more channels to produce a coherent matterwave beam.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology.

According to various aspects of the subject technology, intense directed coherent matterwave beams of particles for Bosons (e.g., particles with integer spins) or Fermions (e.g., particles with half-integer spins), neutral or charged, may be produced. The energy stored in these beams may have virtually zero-entropy, allowing for experimenting with physics in unexplored territories. Coherence in matterwaves, and in particular in Fermions, may be beyond the reach of conventional technologies unless the temperature can be reduced to near-zero. However, even this approach may only work for Bosons using the conventional technologies. Aspects of the subject technology may produce coherence for Bosons, as well as for Fermions, while obviating the use of cryogenics or other technology to implement near-zero temperatures. Thus, room temperature coherence for Bosons, as well as for Fermions, may be produced.

Figure 5:
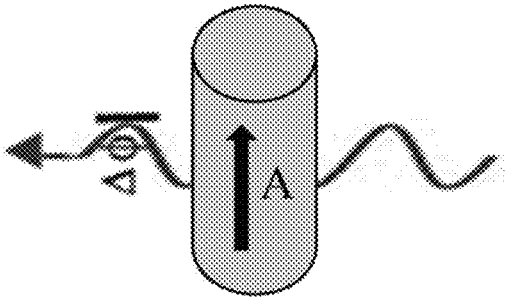
FIG. 5 illustrates the Aharonov-Bohm effect acting on a particle.

According to certain aspects, the Aharonov-Bohm (AB) effect may be used as a stipulant under a noise-seeded resonance condition to induce coherence in matter waves. The AB effect is a demonstrated quantum mechanical effect that can modify a physical system solely through its geometrical parameters, without exchanging any physical quantity. According to the AB effect, the angular phase of a particle inside a vector potential can change even if there are no forces or fields acting on the particle, as shown in FIG. 5. The AB effect was predicted in 1959 by Aharonov and Bohm and physically demonstrated by Tonomura in 1986. In the demonstration, a beam of charged particles is split into two coherent beams, where one beam travels through a field-free vector potential and the other beam travels straight. When the two beams recombine, an interference pattern is observed, which shows that the phase of the beam that went through the field-free potential has been shifted.

Laser technologies involve forcing equal energy photons to have the same phase. With random phase, the field energy available at any point may be proportional to the number of photons N present at that point. When the photons are all at the same phase, the energy available in the field may become redistributed in such a way that the energy available at any point becomes proportional to the square of the number of the photons ($N^2$) present at that point. This phase unification known as coherence may make it possible to assign a single and simple wave function to a large number of photons N, and provide for a local field energy that scales with $N^2$. By doing so, a single wave whose amplitude is simply N times the amplitude of a single photon wave may be achieved, with energy that is $N^2$ times the energy of a single photon.

Fortunately, this dramatic energy enhancement due to phase synchronization of photons is not limited to electromagnetic waves alone. Rather, it is a property of wave phenomena and may be applicable to all kinds of waves. According to quantum mechanics, particles may be waves (e.g., De Broglie's waves) and may be subject to this phase coherence. However, creating coherence among particle waves (e.g., matterwaves) may not be as easy as it is for photon waves, and so far, using conventional technologies, the only achievable coherent matterwave has been at near absolute zero temperatures, and for a very small number of particles (e.g., in the order of thousands or millions of particles) and only for Bosons.

Matterwave coherence for streaming particles (e.g., beams) may open the door to many new technologies and many potential new applications. Matterwave particles carry mass, and thus the potential for concentrating energy to densities far beyond what massless photons are capable of may be much higher. Furthermore, coherent matterwaves may allow Fermions (e.g., electrons) as well as Boson (e.g., photons) to achieve coherence. Examples of applications for coherent matterwave beams may include single bath thermal energy extraction, ultra-sensitive accelerometers and interferometric tracking of air/space crafts, a more accurate alternative to global positioning systems, matterwave projectiles and missiles, directed energy weapons, matterwave optics and cloaking, matterwave emission and propulsion, matterwave solitons, high-energy collision, high precision matter optics, atomic clocks, tests of physics constants, and other suitable applications.

Unlike lasers, where resonance may be the agent in phase modification for coherence, resonance alone may not modify the phase of massive particles without exchanging energy with them. Exchanging energy can destroy the monochromaticity needed for coherence. According to aspects of the subject technology, the AB effect (e.g., a phase modifying process without energy exchange) can be used to modify the phase of massive particles and make the massive particles coherent. With the AB effect, the phase of the massive particles may be shifted without exchanging energy with the massive particles.

According to the least action principle, a physical system can evolve until the system's available energy reaches a minimum (or a maximum). The system may be stable when the minimum in the energy is reached. A system of weakly coupled oscillators may self-organize because the energy exchanged may be minimized when constituents move in harmony (e.g., in phase). It is not complex to show mathematically that when a random oscillator joins an organized crowd, its phase may move gradually towards the phase of the crowd. This exchange of energy to achieve coherence, however, may only work for macroscopic systems. To achieve coherence in particles, the particles' De Broglie phase may need to be modified without exchanging energy. Exchanging energy modifies the De Broglie's wavelength (frequency), thereby making it difficult to synchronize. Since the AB effect is a quantum mechanical effect that can affect matter without causing the exchange of any physical quantity, the AB effect may be used to change the phase of massive particles and produce coherent matterwave beams. Furthermore, AB-induced coherence for the production of matterwaves does not differentiate between Bosons and Fermions. In contrast, the conventional approach for producing coherent matter, the Bose-Einstein condensate, only works for Bosons, and only at very low temperatures (e.g., near-zero temperatures).

Coherence can be more easily achieved under the influence of resonance. In a noise grown resonance, a cavity can be filled with many waves of different wavelengths. Of this multitude of waves, a few may happen to have the right wavelength and the right phase to resonate. As a stipulant acts on these waves in the cavity, more resonantly correct waves may join the resonance and the superposed (e.g., coherent) wave may grow. The unfit waves, which do not have the proper wavelength and the proper phase to join the resonance, may wither and eventually disappear (e.g., transfer the last of their energy to the resonant waves through collision and die out).

According to certain aspects, interconnected micro-cavities may be filled with particles (e.g., atoms, molecules, etc.) and the AB effect may be used to grow resonance, and consequently coherence in the matterwaves in each cavity. Resonance, like self-coherence, can be achieved by itself under proper conditions. However, the process may be slow and may utilize sub-nanometer cavities to grow. Overmoded resonances may be possible in larger (e.g., a few nanometers) cavities but that introduces multiple phases and may be subject to more de-coherence. The AB effect can speed up the process for achieving coherence by inducing a phase shift of proper sign.

As illustrated in FIG. 5, the AB effect may produce a shift in the same direction as the motion of a wave:

$$\Delta\phi = \pm\frac{e}{h}\int_C^D A\cdot ds$$

where Δϕ is the phase shift, e is the fundamental electric charge, h is the Planck's constant, A is the vector potential, and ds is the element of the area. This means that two waves that move in opposite directions (e.g., like a wave and its reflection) may have their phases shifted in opposite directions, which may be favorable to producing a new phase closer to the phase of the bunch. Due to Maxwellian distribution in a thermal motion, about half of the particles on the average may move in one direction while the other half may move in the opposite direction, a natural setting for AB enhanced self-induced coherence. This AB boost in coherence may not only speed up the process for achieving coherence, it may also help keep the number of modes down by encouraging only certain modes to grow. Elastic scattering may also cause a phase shift in the wave function of the particles. However, by controlling the density and the pressure, that effect can be kept at a minimum.

Figure 1:
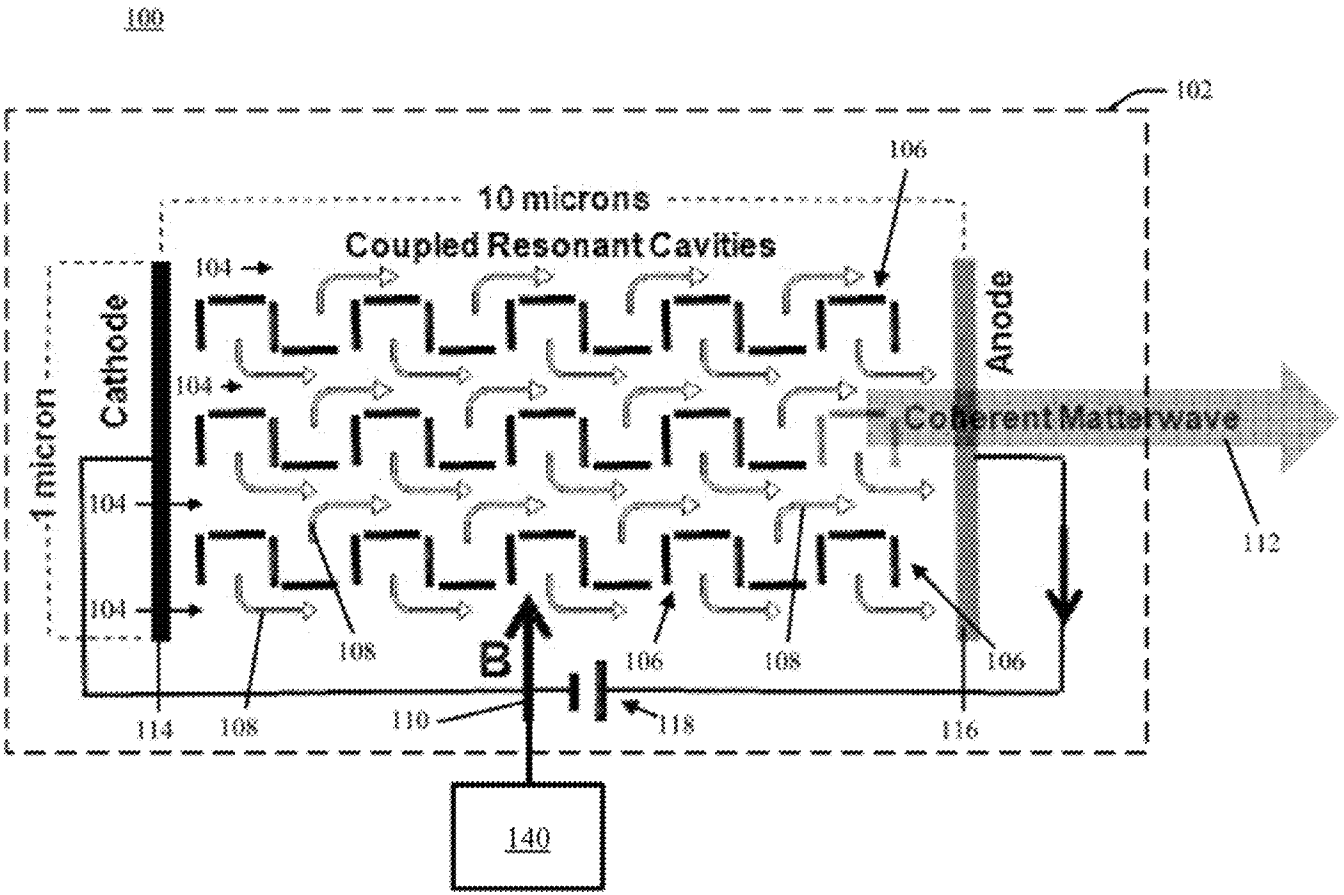
FIG. 1 illustrates an example of a system for generating a coherent matterwave beam, in accordance with various aspects of the subject technology.

FIG. 1 illustrates an example of system 100 for generating coherent matterwave beam 112, in accordance with various aspects of the subject technology. System 100 comprises housing 102 having channels 104. System 100 also comprises beam generating units 106 disposed within housing 102. Each beam generating unit 106 may be configured to generate a stream of charged particles 108 (e.g., electrons). System 100 also comprises a magnetic field generator 140 configured to expose streams 108 to a magnetic field B such that (i) the charged particles of streams 108 undergo phase synchronization with one another in response to a vector potential associated with the magnetic field B and (ii) the streams 108 are directed along channels 104 to combine with one another and produce coherent matterwave beam 112.

According to certain aspects, the streams of massive particles 108 may be produced under the influence of a diode-like external electric field in a mesh of beam generating units 106 (e.g., microscopic sized cavities). After being accelerated in the electric field to the desired energy, the streams may be exposed to an external magnetic vector potential, where the phases of the particles may be modified elastically and brought to a common value (e.g., coherence), under the global influence of the least action principle that tends to minimize the overall potential energy of system 100 through synchronization. This is a quantum mechanical counterpart to the well-known phenomena of self-organization observed naturally in various systems including physical systems, such as magnetic domains, as well as biological systems, such as fish, birds, bees, etc. This process produces low-entropy coherent matterwaves with potentials unprecedented in condensed energy technologies. Beam generating units 106 may also be linked to each other through apertures in the walls of beam generating units 106. The apertures provide a coupling between the cavities of beam generating units 106 that cause phase synchronization across the cavities. Phase synchronization within the cavities may be a consequence of the AB effect. In a few hundred nanoseconds, depending on the strength of the magnetic field B and the size of the cavities, a mass of coherent particles may be streaming in the entire mesh to produce coherent matterwave beam 112.

FIG. 1 illustrates a top view of one layer of system 100. System 100 may also comprise multiple stacked layers, but one layer may be adequate in most cases. Each layer may be a housing 102, which can be approximately 10 microns long, 1 micron wide, and 0.1 microns thick. However, housing 102 may comprise other suitable dimensions greater than or less than these dimensions. The magnetic field B may be perpendicular to the electric field of each beam generating unit 106. It can be either perpendicular to the plane of view, or parallel to it. One beam generating unit 106 or hundreds of beam generating units 106 may be disposed in housing 102, for example. According to certain aspects, housing 102 may be a vacuum housing. Thus, the streams of charged particles 108 may be generated in a vacuum. Housing 102 also comprises channels 104. Although four channels 104 are shown, housing 102 may comprise more or less channels. For example, housing 102 may comprise at least 100 channels.

System 100 also comprises an electric field generator having main cathode 114, main anode 116, and voltage source 118. Beam generating units 106 are disposed between main cathode 114 and main anode 116. Channels 104 are aligned with main cathode 114 and main anode 116. The electric field generator may generate an electric field between main cathode 114 and main anode 116. In one example, the electric field generator may be connected to each of the beam generating units 106 so that each of the beam generating units 106 may generate its own electric field and stream of charged particles 108.

Figure 2:
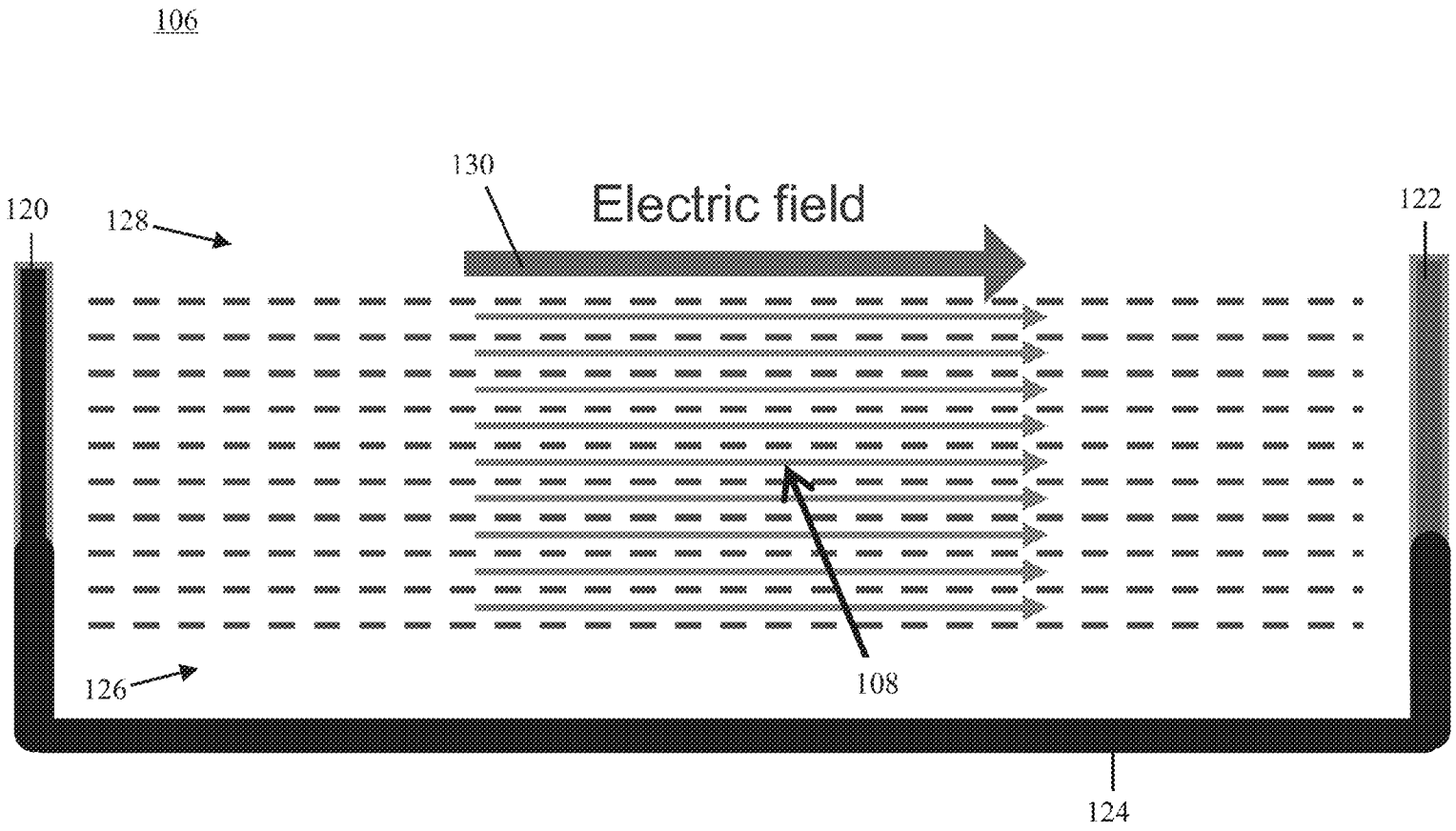
FIG. 2 illustrates an example of a beam generating unit, in accordance with various aspects of the subject technology.

FIG. 2 illustrates an example of beam generating unit 106, in accordance with various aspects of the subject technology. Beam generating unit 106, for example, may comprise a diode. Beam generating unit 106 comprises cavity 126 formed within cathode wall 120, anode wall 122, and one or more intermediate walls 124, which joins cathode wall 120 and anode wall 122. Cathode wall 120, for example, may comprise a cathode, and anode wall 122 may comprise an anode. Cathode wall 120 and anode wall 122 are opposite one another. Cathode wall 120 and anode wall 122 are perpendicular to channels 104, while the one or more intermediate walls 124 are parallel to channels 104.

Cathode wall 120 may be connected to main cathode 114, and anode wall 122 may be connected to main anode 116. Thus, beam generating unit 106 may generate stream of charged particles 108 as well as electric field 130 between cathode wall 120 and anode wall 122. For example, beam generating unit 106 may generate stream of charged particles 108 using dielectric barrier discharge. However, other suitable methods known to those of ordinary skill in the art may be used for generating the stream of charged particles 108. The charged particles may be emitted from cathode wall 120 to anode wall 122. According to certain aspects, the charged particles of stream 108 may be generated with substantially the same non-zero kinetic energy as one another, which may allow the charged particles to achieve coherence with one another. In contrast to conventional technologies, where particles of coherent matterwaves such as the Bose-Einstein condensate achieve the same kinetic energy relying on cryogenics (e.g., making the kinetic energy zero so that the particles have the same zero kinetic energy), aspects of the subject technology may produce coherent matterwaves in which the charged particles of the coherent matterwaves exhibit the same non-zero kinetic energy without the use of cryogenics.

According to certain aspects, in order to minimize collisions between the charged particles of stream 108 with one another, a length of beam generating unit 106 (e.g., the length between cathode wall 120 and anode wall 122) may be less than a mean free path of the charged particles of stream 108. The mean free path may be an average distance that a particle may travel before colliding with another particle. Thus, because the length of beam generating unit 106 is less than the mean free path of the charged particles of stream 108, collisions between the charged particles may be minimized.

Beam generating unit 106 further comprises channel opening 128 connecting cavity 126 to channels 104. Channel opening 128 may be parallel to channels 104 and/or one or more intermediate walls 124, and is formed between cathode wall 120 and anode wall 122. According to certain aspects, the magnetic field B is perpendicular to electric field 130. Thus, stream 108, which is generated within cavity 126, may be bent and directed to outside of cavity 126 through channel opening 128 to channels 104. By directing stream 108 to channels 104, stream 108 may be combined with other streams of charged particles to produce coherent matterwave beam 112.

Beam generating units 106 may be aligned in one or more rows. For example, as shown in FIG. 1, beam generating units 106 are aligned in three rows between four channels 104. In some aspects, adjacent beam generating units 106 may share at least one of cathode wall 120 and anode wall 122 with one another to conserve space. The shared wall may comprise an aperture for linking the cavities of the adjacent beam generating units 106. The aperture may allow not only the charged particles within one cavity to be synchronized with one another, but also the charged particles from one cavity to be synchronized with the charged particles of another cavity. In some aspects, apertures may be used (e.g., formed on cathode wall 120 and/or anode wall 122) to link the charged particles along an entire row of beam generating units 106. In some aspects, channel openings 128 of adjacent beam generating units 106 may connect to different channels 104. For example, a beam generating unit 106 of a particular row may have a channel opening 128 that connects to channel 104 beneath the row, while an adjacent beam generating unit 106 may have a channel opening 128 that connects to a channel 104 above the TOW.

According to various aspects of the subject technology, the magnetic field B may bend each stream of charged particles 108 within a respective cavity 126 into a respective channel 104. In this regard, the streams 108 may further combine with one another in the channels 104 to produce coherent matterwave beam 112. The charged particles of streams 108 may undergo phase synchronization with one another in response to a vector potential associated with the magnetic field B. While the streams 108 are in the channels 104, the charged particles of the streams may undergo further phase synchronization with one another to form coherent matterwave beam 12. In some aspects, the charged particles may undergo phase synchronization with one another utilizing the AB effect. For example, the charged particles may undergo phase synchronization with one another without exchanging energy with one another. According to certain aspects, the magnetic field B may be about 100 gauss. However, the magnetic field B may be lower or higher depending on the configuration of beam generating units 106, the desired size of coherent matterwave beam 112, the application of coherent matterwave beam 112, etc.

According to certain aspects, system 100 may produce coherent matterwave beam 112 without using cryogenics. Furthermore, the charged particles of the coherent matterwave beam 112 may comprise not only Bosons, but also Fermions. While conventional technologies may produce coherent matterwaves in the form of the Bose-Einstein condensate, which may comprise a low number of particles (e.g., hundreds of thousands of particles to a million particles), coherent matterwave beam 112 may comprise many more particles (e.g., at least one billion charged particles).

The physics and the mathematics of self-induced coherence may be complex. Rather than presenting a quantum mechanical model, a macroscopic model of coherence such as the Kuramoto model may be used to describe aspects of the subject technology. With AB-induced self-coherence, some simplifying assumptions can be made to make the mathematics more manageable. A numerical approach may be possible based on these assumptions. Even though a dynamical time-evolving solution to the state function for AB synchronization of matterwaves may be difficult to obtain, characteristic times, major viability criteria, and effectiveness measures can be worked out. The characteristic time-to-synchronization, viability, and effectiveness is discussed herein. The mean free path of the particles desired to be synchronized may be important to consider.

Inter-Oscillator Coupling and Analysis

Figure 3:
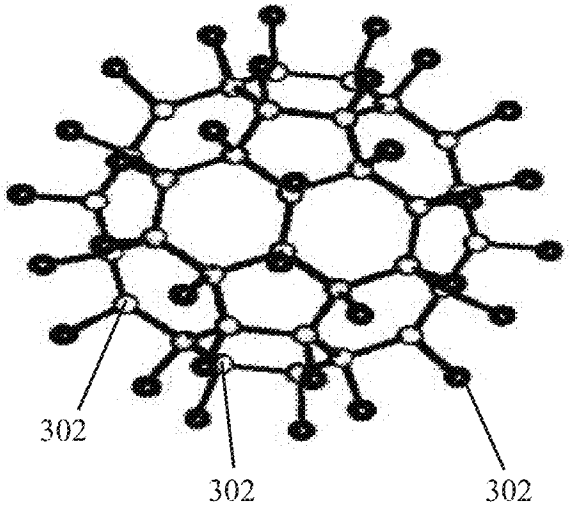
FIG. 3 is a schematic drawing of the coupling between neighboring particles, in accordance with various aspects of the subject technology.

An approach to inter-oscillator coupling analysis may be based on oscillators (e.g., particles) being weakly coupled to each other, and the strength of the coupling may be inversely proportional to the distance between the oscillators. A thorough analysis may require that every oscillator influence and be influenced by every other oscillator. Implementing this requirement however can lead to unmanageable mathematics. A non-complex approximation may assume each oscillator is coupled to the nearest set of oscillators (e.g., a shell of nearest neighbors). In this analysis, it can be assumed that each oscillator is coupled to at least four sets (e.g., shells) of nearest neighbors, as illustrated in FIG. 3. In particular, FIG. 3 is a schematic drawing of the coupling between neighboring particles 302, in accordance with various aspects of the subject technology. To avoid clutter, not all links between particles 302 are shown.

Collision Frequency and Mean Free Path

According to certain aspects, the mean free path in a plasma of pressure p and temperature T may be given by $$\lambda = k_B T/(2^{1/2}\pi d^2 p),$$

where d is the effective interaction diameter of the particles. Assuming a spherical shape, the effective cross-section for the collision may be $\pi d^2$. Assuming atmospheric pressure and ambient temperature, the effective cross-section for electrons may be roughly $3\times10^{-24}$ $m^2$, so that the mean free path $\lambda$ may be approximately $9.3\times10^{-3}$ m. At room temperature (e.g., 100 km/s for electrons), the characteristic time $t_c$ between collisions may be approximately 100 ns. However, the distance between the cathode and the anode (AK gap) may be 0.1 mm, which is roughly 100 times shorter than the mean free path. This means that the electrons may hit the anode long before they would have a chance to collide with one another and thermalize (e.g., called "ballistic transport"). With the geometry of the subject technology, thermalization may not be an issue, and if a partial vacuum is introduced into system 100 for example, the mean free path can be increased to several centimeters, allowing for larger cavities and more extended AK gaps (e.g., about 1 mm).

Characteristic Time to AB Induced Coherence

According to the least action principle, system constituents (e.g., charged particles) undergoing dynamical evolution may select paths that minimize (or maximize) the action. Action (e.g., in tensor form) may be defined as the time integral of the Lagrangian along a path connecting two fixed points:

$$S|q(t)| = \int_{t_1}^{t_2} L[q(t), \dot{q}(t), t]dt$$

$$\mathcal{L}_K = \sum_f \bar{f}(i\dot{\phi} - m_f)f - \frac{1}{4}A_{\mu\nu}A^{\mu\nu} - \frac{1}{2}W_{\mu\nu}^{+}W^{-\mu\nu} + m_W^2 W_\mu^{+}W^{-\mu} - \frac{1}{4}Z_{\mu\nu}Z^{\mu\nu} + \frac{1}{2}m_Z^2 Z_\mu Z^\mu + \frac{1}{2}(\partial^\mu H)(\partial_\mu H) - \frac{1}{2}m_H^2 H^2$$

Although a thorough quantum mechanical analysis of AB induced coherence using least action principle for finding the characteristic time T may be a major undertaking and may be possible only through a numerical approach, implementing a major simplifying assumption for aspects of the subject technology may make it possible to estimate T with reasonable accuracy. Since the electrons may be confined to move from the cathode to the anode under the influence of the diode potential, the paths the electrons take may be assumed to be straight lines connecting the cathode to the anode.

Synchronization Rate and Characteristic Times

The characteristic time T may be a function of the synchronization rate. The classical version of a synchronization process may be used, and according to the Kuramoto model (or an Ising model), the synchronization rate, dq/dt, may be given by $$d\theta_i/dt = \omega_i + \sigma K_{ij}\sin(\theta_j - \theta_i),\ i = 1, 2, \ldots N,$$

where θ is the relative phase, the tensor σK is the strength of the synchronizing agent and N is the number of the particles. Notice that the rate relaxes as the phase of individual particles approaches the common phase and sin(δθ) approaches zero. This may guarantee accumulation in phase space, which may be important in synchronization. The Kuramoto model, and other classical analyses, may start out with a Hamiltonian, calculate the density of particles with the phase in a certain range, and solve for the evolution as a function of time. A quantum mechanical approach may follow the same path, but through $2^{nd}$ quantization:

$$H_{tot} = \sum_{j=e,h}\left(\vec{P}_j + q_j\vec{A}_j\right)\frac{1}{2m_j}\left(\vec{P}_j + q_j\vec{A}_j\right) + V_c\left(\vec{r}_e - \vec{r}_h\right) + \sum_{j=e,h} V_j\left(\vec{r}_j\right) - eEz_e + eEz_h,$$

The classical formula may be assumed to be a good approximation at this point. Numerical approach for quantum mechanical analysis may be possible.

Figure 4B:
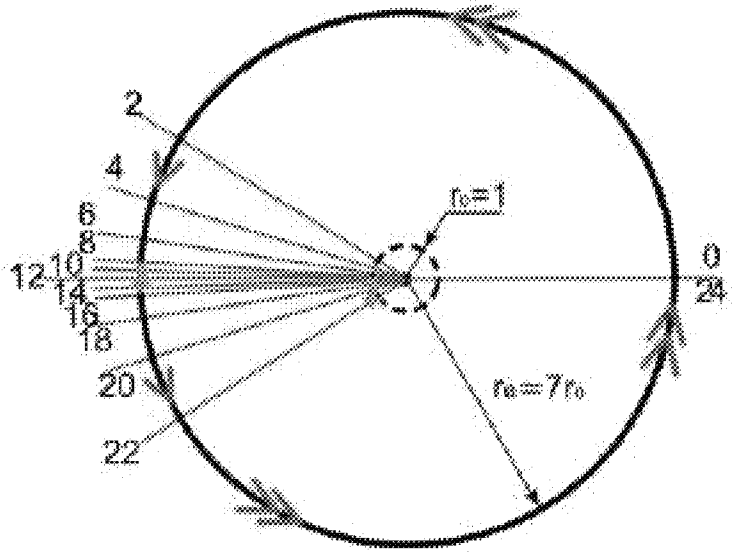
FIGS. 4A and 4B illustrate an example of the distribution of phases before and during synchronization, in accordance with various aspects of the subject technology.
Figure 4A:
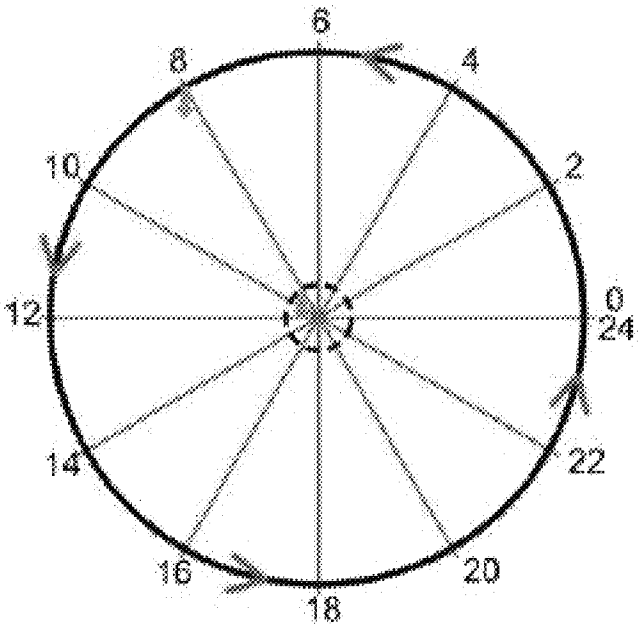

Prior to synchronization, the electron phases in the ensemble may be random, as shown in FIG. 4A. FIGS. 4A and 4B illustrate an example of the distribution of phases before (FIG. 4A) and during (FIG. 4B) synchronization, in accordance with various aspects of the subject technology. Under the influence of the AB effect and depending on the value with respect to a peak or a trough, the phases either may advance or retreat until they all converge on one value. Once synchronization takes hold, the phases may shift together and a steady state may be reached. Based on the Kuramoto model, for very large N, the synchronized particle density may be given by $$\rho = \delta\left(\theta - \psi - \arcsin\left(\frac{\omega}{Kr}\right)\right),$$

where ψ is the average phase and δ is an inverse measure of noise in the system.

The dynamics of the Kuramoto model for synchronization may be given by $$d\theta_i/dt = \omega_i + (K/N)\sin(\theta_j - \theta_i)\ i = 1, 2, \ldots N.$$

According to the Kuramoto model, there may be a critical coupling-gain parameter $K_c$ below which synchronization is not possible. If we define an order parameter r as $$re^{i\phi} = (1/N)\Sigma_{j=1,N}e^{i\theta j},$$

where r is a function of time, r may be less than one as t goes to infinity for super-critical K. By taking the derivative of this equation with respect to time and based on some algebra, it can be shown that, when frequencies are the same, r may be constant and less than 1, as illustrated below:

$$re^{i\phi} = (1/N)\Sigma_{j=1,N}e^{i\theta j}$$

$$d/dt(re^{i\phi}) = (1/N)\Sigma_{j=1,N}d/dt(e^{i\theta}{}_j)$$

$$(dr/dt)e^{i\phi} + ir(d\phi/dt)e^{i\phi} = (1/N)\Sigma_{j=1,N}(d\theta/dt)e^{i\theta j}$$

$$(dr/dt)e^{i\phi} + ir(d\phi/dt)e^{i\phi} = (id\theta/dt)_j/N)\Sigma_{j=1,N}e^{i\theta j}$$

$$(dr/dt)e^{i\phi} + ir(d\phi/dt)e^{i\phi} = i(d\theta_j/dt)re^{i\phi}, d\theta/dt = \omega$$

$$dr/dt + ir(d\phi/dt) = ir\omega, \text{ but } d\phi/dt = \omega$$

$$dr/dt = 0.$$

$$r = \text{constant}$$

This shows that for monochromatic beams, the critical coupling-gain may be zero. Thus, such a system may always synchronize.

According to Chopra and Spong, a synchronization rate may be given by $$\Delta\phi = e^{-(\beta t/2)},$$

where β is the magnetic coupling constant, and may be given by $$\beta = \phi^2{}_m v/(2hc\mu_0)d.$$

ϕ is the elementary magnetic charge (h/e), v is the velocity of the charged particles, h is the Planck constant, c is the speed of light, $\mu_0$ is the magnetic constant, and d is the lateral extent of the particle beam. Upon substituting for these constants and the geometrical/kinematical parameters for the beam at 1 Tesla, the value of β is $1.02\times10^9\ s^{-1}$, which means it can take 4 ns for Δϕ to reduce two e-fold. So the characteristic time for synchronization may be approximately 4 ns.

A challenge to phase synchronization of matter particles is to keep every particle at the same energy (e.g., same wavelength) and shift the phase without changing the energy. Conventional methods lower the temperature to near absolute zero (e.g., to guarantee monochromaticity) and work with a small number of particles. These methods require cryogenics, only work for Bosons, and do not produce streaming beams (only a stationary blob). For these reasons, intense streaming beams of coherent massive particles have not been produced. Use of cryogenics for monochromatization may be cumbersome and inconsistent with beaming, as cryogenics may involve the particles being brought to the ground (zero) level energy for synchronization.

There is no easy way to synchronize Fermions even with cryogenics because of Pauli's exclusion principle that forbids putting identical particle in the same state. The Fermions may not get close enough to each other to affect the proper interaction needed for synchronization. The total number of synchronized particles may also be limited because of the need for trapping the particles prior to cooling and synchronization. There may not be a steady flow of new particles brought in.

According to various aspects of the subject technology, using the AB effect for coherence induction and using coherence growth in microcavities that combine resonance with coherence may allow the foregoing obstacles to be overcome, thereby paving the road for the production of an energetic intense beam of coherent matterwaves. Because the AB effect is a phase-shifting process that does not change the energy of the particles, coherence can be achieved while keeping the wavelength the same for all particles. The number of particles may not be limited because new particles may be constantly emitted from the cathode while upstream particles may undergo synchronization. The diode action of cavity walls may accelerate the particles to a fixed energy. Coherent beams of energetic particles may be produced at any kinetic energy by adjusting the electrode potential across the cathode wall and the anode wall (e.g., AK gap). This approach may work for Fermions as well as for Bosons without discriminating effects. The particles need not be in the same state to synchronize.

Room temperature matterwave coherence may be beyond the reach of conventional technology. In contrast, aspects of the subject technology achieve room temperature matterwave coherence that is suitable for Bosons as well as Fermions. According to certain aspects, particles interact globally (e.g., are aware of each other) without energy exchange, and phases of the particles are shifted without energy exchange. In this approach, the magnetic vector potential may establish the universal energy-free link between particles and the AB effect may guarantee the energy-free phase shift.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as an "aspect" may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as a "configuration" may refer to one or more configurations and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A system comprising:

a plurality of beam generating units disposed proximate to one or more channels, wherein each of the plurality of beam generating units comprises a cavity formed between a cathode wall and an anode wall opposite the cathode wall, and one or more intermediate walls joining the cathode wall and the anode wall, wherein the cathode wall and the anode wall are perpendicular to the one or more channels;

a magnetic field generator configured to generate a magnetic field that is orthogonal to the one or more channels; and an electric field generator having a main cathode, a main anode, and a voltage source, the electric field generator configured to generate an electric field between the main cathode and the main anode parallel to the one or more channels.

2. The system of claim 1, further comprising a housing having the one or more channels formed therein, wherein the housing is a vacuum housing, and wherein the plurality of beam generating units is disposed within the housing.

3. The system of claim 1, wherein a length of each of the plurality of beam generating units is less than 9.3 mm.

4. The system of claim 1, wherein the cathode wall comprises a cathode, and wherein the anode wall comprises an anode.

5. The system of claim 1, wherein each of the plurality of beam generating units further comprises a channel opening connecting the cavity to the one or more channels.

6. The system of claim 1, wherein at least two of the plurality of beam generating units are aligned in a row.

7. The system of claim 6, wherein adjacent ones of the row of beam generating units share at least one of a cathode wall and an anode wall with one another.

8. The system of claim 7, wherein the shared wall comprises an aperture for linking cavities of the adjacent ones of the row of the beam generating units.

9. The system of claim 1, wherein the plurality of beam generating units are disposed between the main cathode and the main anode.

10. A method comprising:

generating a plurality of streams of charged particles in one or more channels using a plurality of beam generating units, wherein each of the plurality of beam generating units comprises a cavity formed between a cathode wall and an anode wall opposite the cathode wall, and one or more intermediate walls joining the cathode wall and the anode wall wherein the cathode wall and the anode wall are perpendicular to the one or more channels;

exposing the plurality of streams to a magnetic field that is orthogonal to the one or more channels; and exposing the plurality of streams to an electric field that is parallel to the one or more channels.

11. The method of claim 10, wherein the magnetic field is approximately 100 Gauss.

12. A system comprising:

a housing having one or more channels formed therein;

at least one beam generating unit disposed within the housing, the at least one beam generating unit comprising a cavity formed between a cathode wall and an anode wall opposite the cathode wall, and one or more intermediate walls joining the cathode wall and the anode wall wherein the cathode wall and the anode wall are perpendicular to the one or more channels, wherein the cathode wall comprises a cathode the anode wall comprises an anode, and wherein a length of the at least one beam generating unit is less than 9.3 mm;

a magnetic field generator configured to generate a magnetic field that is orthogonal to the one or more channels and approximately 100 Gauss; and an electric field generator coupled to the housing, the electric field generator having a main cathode, a main anode, and a voltage source, the electric field generator configured to generate an electric field between the main cathode and the main anode parallel to the one or more channels.

13. The system of claim 1, wherein the magnetic field is approximately 100 Gauss.

* * * * *